US007785084B1

(12) United States Patent
Rawlings et al.

(10) Patent No.: US 7,785,084 B1
(45) Date of Patent: Aug. 31, 2010

(54) METHOD AND APPARATUS FOR ELIMINATION OF GASES IN PUMP FEED/INJECTION EQUIPMENT

(75) Inventors: David Rawlings, Sound Beach, NY (US); Harry E. Pinkerton, III, Bayville, NY (US)

(73) Assignee: Fluid Metering, Inc., Syosset, NY (US)

( * ) Notice: Subject to any disclaimer, the term of this patent is extended or adjusted under 35 U.S.C. 154(b) by 1087 days.

(21) Appl. No.: 11/414,703

(22) Filed: Apr. 28, 2006

Related U.S. Application Data

(63) Continuation-in-part of application No. 11/226,733, filed on Sep. 14, 2005, now Pat. No. 7,387,502.

(60) Provisional application No. 60/610,471, filed on Sep. 16, 2004, provisional application No. 60/612,621, filed on Sep. 23, 2004.

(51) Int. Cl.
*F04B 7/06* (2006.01)
*F01B 29/00* (2006.01)
*B01D 19/04* (2006.01)

(52) U.S. Cl. ..... 417/500; 92/162 R; 92/169.1; 96/155; 95/241

(58) Field of Classification Search ..... 417/492, 417/500; 92/162 R, 169.1; 95/241, 260; 96/95, 155, 204, 255
See application file for complete search history.

(56) References Cited

U.S. PATENT DOCUMENTS 1,223,122 A * 4/1917 Subry ..... 417/492
2,276,225 A 3/1942 Carter
2,771,880 A 11/1956 Gotthart
2,970,021 A 1/1961 Glaser et al.
3,153,385 A * 10/1964 Le Baron Bowen, Jr. .... 417/490
3,511,512 A 5/1970 Wheelock
4,822,059 A 4/1989 Shimasaki et al.
4,941,809 A 7/1990 Pinkerton
5,015,157 A 5/1991 Pinkerton et al.
5,020,980 A 6/1991 Pinkerton
5,044,889 A 9/1991 Pinkerton
5,092,037 A 3/1992 Pinkerton
5,209,502 A 5/1993 Savoia
5,472,320 A * 12/1995 Weisbrodt ..... 417/326
5,601,421 A * 2/1997 Lee ..... 417/492
5,921,555 A 7/1999 Johnston
5,941,533 A 8/1999 Jacobsen et al.
6,095,780 A 8/2000 Ernens
6,409,175 B1 6/2002 Evans et al.
6,428,013 B1 8/2002 Johnston et al.
2002/0176791 A1* 11/2002 Uera ..... 417/500
2004/0241023 A1 12/2004 Pinkerton et al.
2006/0169134 A1* 8/2006 Dunaevsky et al. ..... 92/240

* cited by examiner

*Primary Examiner*—Charles G Freay
(74) *Attorney, Agent, or Firm*—Hoffman & Baron, LLP

(57) ABSTRACT

A pumping apparatus for pumping a liquid from a source to a target includes a pump having a pump housing and a pump piston. The pump housing defines a central longitudinal bore, a transverse bore communicating with the central bore for conveying a liquid through the pump housing and a liquid reservoir communicating with the central bore and the transverse bore for retaining an amount of the liquid conveyed through the transverse bore. The pump piston is axially and rotatably slidable within the central longitudinal bore for pumping the liquid through the transverse bore.

8 Claims, 6 Drawing Sheets

METHOD AND APPARATUS FOR ELIMINATION OF GASES IN PUMP FEED/INJECTION EQUIPMENT

CROSS-REFERENCE TO RELATED APPLICATIONS

This application is a continuation-in-part application of U.S. Ser. No. 11/226,733, filed Sep. 14, 2005 now U.S. Pat. No. 7,387,502, which claims the benefit of U.S. Provisional Application No. 60/610,471, filed on Sep. 16, 2004 and U.S. Provisional Application No. 60/612,621, filed on Sep. 23, 2004.

FIELD OF THE INVENTION

The present invention relates generally to liquid pumping systems, wherein one liquid is pumped or fed into the stream of another liquid. More particularly, the present invention relates to a method and apparatus that minimizes gases in the liquid pumping system.

BACKGROUND OF THE INVENTION

There are situations in which it is necessary to inject or feed one liquid into the stream of another liquid. Some liquid pumping systems require an occasional injection of liquid while others need a more continuous feed of the liquid. Still others might require a combination of the two. For purposes of this disclosure, it is understood that the term "feed" will include inject.

One such common application is in the field of water treatment wherein certain chemicals, such as chlorinating solutions, fluorination chemicals and other liquids, are fed into the water stream at a point prior to its delivery for end use by consumers. It is important to maintain certain percentage levels of these added liquids in order to assure adequate functionality without exceeding predetermined concentrations which could be objectionable or even harmful to the consumer.

A variety of apparatus is available in the industry to perform this chemical feed task. Such apparatus typically takes the form of a pump, wherein pump speed and chemical feed rate is controlled by well known electronic means which employs chemical concentration detection means and provides voltage or current signal output for use by the pump drive system to adjust its feed rate. This system operates in a closed loop fashion to maintain a relatively stable concentration of the desired chemical in the water stream.

Certain chemicals, particularly sodium hypochlorite (NaOCl) solution used for chlorination of the water system, exhibit the troublesome characteristic of constant gas generation. Specifically, the liquid NaOCl spontaneously outgases in such a way that bubbles form in conduit piping, fittings and any other cavities in the feed circuit. Positive displacement pumps attempting to draw this liquid from storage tanks and feed it into the water stream can become gas-bound when encountering such gas bubbles. Once gas-bound, the pump will simply work against a "springy" bubble, which will alternately compress and expand to entirely devour the pump's displacement stroke volume. At this point, feeding of liquid chemical into the water stream ceases and the pump will uselessly run without effect.

This problem is aggravated by the often encountered requirement to feed the liquid chemical directly into a pressurized water stream. Here, even a modest sized gas bubble will give rise to a gas bound condition as the pump unsuccessfully attempts to compress the gas sufficiently to force it out of the pump chamber against the water stream back pressure. The problem is sufficiently severe that certain water treatment facilities undertake the extra step of diluting the sodium hypochlorite solution in the liquid chemical supply tank in order to reduce gas bubble formation. It can be reliably stated that the most aggravating problem known in the water chlorination and disinfection industry is the off-gas generated by the sodium hypochlorite NaOCl solution.

Another related problem is associated with priming. Once a chemical vessel is emptied, the feed apparatus will draw in air and entirely fill the intake circuit (including tubing, fittings, internal chambers and such) with this air. The chemical concentration detection apparatus will then signal or alarm for intervention by a technician. Chemical feed restoration now requires that a full liquid chemical vessel be substituted for the empty vessel followed by a troublesome and time consuming sequence of valve openings/closings by a skilled technician to bleed offending air out of the circuit in order to prime the pump. Only after the technician confirms by observation that the feed pump is actually feeding liquid into the water stream can the task be considered completed. This problem of manual bleeding is common to any liquid chemical application and is in addition to and apart from the outgassing characteristics of NaOCl solutions.

Numerous attempts have been made to solve the problems described herein. For example, it is known in the field to incorporate a solenoid operated purge valve in a liquid pump, which is manually or automatically operated to divert the pressure output port of the feed pump away from the pressurized water stream and back to the liquid chemical supply tank. Once liquid has filled the pump circuit, the valve is shifted back so as to direct the chemical liquid into the pressurized water stream. However, the drawbacks of such prior art solutions include complex electronics, additional valves, manual intervention or urgent attention on the part of technicians.

Accordingly, it is desirable to provide a simply designed system, wherein gas bubbles are dispatched automatically while replacement of an empty liquid chemical supply tank and commissioning of a new full tank is simply done by switching input tubing from the empty to the full tank. It would be further desirable to provide an apparatus requiring no priming and does not require the pump to be turned off when changing liquid supplies. It would also be desirable for such an apparatus to be substantially leak-free and less prone to chemical precipitate build-up with resultant mechanical failure.

SUMMARY OF THE INVENTION

The present invention is a pumping apparatus for pumping a liquid from a source to a target including a motor, a first pump driven by the motor, a second pump driven by the motor and a separator in fluid communication with the first and second pump for separating a liquid received from a source into a gaseous component and a liquid component. The separator further diverts the gaseous component to the first pump and the liquid component to the second pump, wherein the first pump pumps the gaseous component back to the source and the second pump pumps the liquid component to a target.

In a preferred embodiment, the separator is a T-fitting having a downward oriented arm for separating the liquid component under the influence of gravity and permitting horizontal flow of the gaseous component. The apparatus further preferably includes a substantially vertically oriented tube connecting the downward arm of the T-fitting to the pump. Also, the motor, the first pump and the second pump are substantially horizontally arranged.

The pumping apparatus of the present invention is preferably contained in a portable and mountable case having an inlet mounted thereon for fluidly connecting the separator to the liquid source, a gas outlet mounted thereon for fluidly connecting an output port of the first pump to the liquid source and a liquid outlet mounted on the case for fluidly connecting an output port of the second pump to the target. The case further preferably includes a hinged cover for permitting access to the motor, pumps and separator contained in the case and a drain outlet for draining any fluid leakage from the interior of the case. The hinged cover may be suspended from the case in a substantially horizontal position by a lanyard.

The pumping apparatus can be provided with a wash-water subsystem for cleaning the first and second pumps. The wash-water subsystem preferably includes tubing connected to the first and second pumps for delivering wash-water to the pumps and a flow restrictor for regulating the flow of the wash-water to the pumps.

The present invention further involves a method for pumping a liquid from a source to a target. The method generally includes the steps of separating the liquid into a gaseous component and a liquid component, diverting the gaseous component to a first pump, diverting the liquid component to a second pump, pumping the gaseous component back to the liquid source with the first pump and pumping the liquid component to the target with the second pump.

Thus, the present invention calls for the use of a separate pump whose function is to draw whatever is in the intake line up to a point above the intake for the primary feed pump. At this point there is a T-fitting with a large diameter pipe connection leading downwards to the intake port of the main feed pump. The output line of the first pump is connected to tubing which leads back to the liquid chemical supply tank. There is little or no restriction to the flow of liquid through the first pump so it experiences no difficulty drawing gas, liquid or a combination thereof out of the chemical supply tank and returning it back again to this same tank.

As liquid or gas passes over the down facing port of the T-fitting on its way to the input of the first pump, liquid falls down under the influence of gravity to the intake port of the primary feed pump (second pump). This intake port, in turn, is angled upwards so that it becomes flooded with liquid. A suitably designed pump is then able to self clear small amounts of gas so long as its intake port is flooded with liquid.

In a preferred embodiment, at least one of the pumps of the present invention includes a pump housing and a pump piston. The pump housing defines a central longitudinal bore, a transverse bore communicating with the central bore for conveying a liquid through the pump housing and a liquid reservoir communicating with the central bore and the transverse bore for retaining an amount of the liquid conveyed through the transverse bore. The pump piston is axially and rotatably slidable within the central longitudinal bore for pumping the liquid through the transverse bore.

In this embodiment, the pump housing further preferably includes an inlet port and an outlet port, and the transverse bore includes an inlet portion extending between the inlet port and the central bore and an outlet portion extending between the central bore and the outlet port. A pressure relief slot is preferably formed in the central bore between the inlet portion of the transverse bore and the liquid reservoir to facilitate liquid flow therebetween. The central bore further preferably terminates at an opening formed in the housing. The piston extends out from the opening and the pressure relief slot extends from the inlet portion of the transverse bore to the housing opening.

A lip seal assembly is preferably disposed at the housing opening for sealing the piston. The lip seal assembly includes two annular lip seals having lip portions in sliding contact with the piston. The lip portions of the lip seals are bent outwardly away from the housing opening to facilitate scraping of the piston. In this regard, the piston further preferably includes an outer surface having a vapor-deposited polytetrafluoroethylene (PTFE) coating.

The present invention further involves a method for preventing the formation of precipitates in a liquid chlorine solution pump. The method includes the steps of moving a piston within a bore of the pump to draw liquid chlorine solution into the pump, moving the piston within the bore to force liquid chlorine solution out of the pump and retaining an amount of the liquid chlorine solution in a liquid reservoir formed in the pump. The liquid reservoir is in fluid communication with the pump bore and the amount of the liquid chlorine solution retained in the reservoir is sufficient to prevent crystallization of the chlorine solution in the pump during an idle period of the pump. The volume of liquid retained by the reservoir is preferably at least approximately 0.7 cc. Retaining an amount of liquid chlorine solution in the liquid reservoir essentially decreases the surface to volume ratio of the liquid chlorine solution, thereby reducing evaporation and consequential formation of crystals within the pump.

As described above, one embodiment of the present invention provides for a wash-water subsystem configured to continuously flush the pumps internal structures. This is done for two reasons:

- Reduce crystallization caused by evaporation of sodium hypochlorite.
- Establish a water barrier between the sodium hypochlorite and the lip seals, thereby assuring that any leakage past said lip seals is merely water and not sodium hypochlorite solution.

An unanticipated consequence of this arrangement is that, in certain situations, dissolved metallic salts in the wash water (notably the copper salts) can react with the sodium hypochlorite solution to form insoluble precipitates which can build up on the internal structures of the pump and ultimately lead to seizure of the moving parts. Such dissolved metallic salts can be eliminated through the use of purified water but the cost and additional complications associated with this arrangement has led to the improved non-wash water embodiment described herein.

In a preferred embodiment, the step of drawing liquid chlorine solution into the pump involves the step of creating a negative pressure in an inlet of the pump and the step of forcing liquid chlorine solution out of the pump involves the step of creating a positive pressure in an outlet of the pump. The inlet and the outlet are in fluid communication with the liquid reservoir, whereby the negative and positive pressures induce a flow of liquid chlorine solution between the liquid reservoir and the inlet and the outlet via a pressure relief slot formed in the pump bore. This negative pressure is communicated directly to the lip seal area such that, in the absence of a positive pressure, sodium hypochlorite solution is encouraged to stay inside the pump instead of being expelled past the sealing face of the lip seal.

As a result of the present invention, an apparatus is provided which utilizes a novel means for dealing with the presence of gas in the liquid chemical intake plumbing. Also, the design of the present invention further provides the ability to self prime against a pressurized system, even in the event of total gas entrainment into the intake liquid circuit. Thus, the present invention is particularly suitable for use as part of a chlorination system for delivering a chlorine solution into a water supply.

The preferred embodiments of the apparatus and method of the present invention, as well as other objects, features and advantages of this invention, will be apparent from the following detailed description, which is to be read in conjunction with the accompanying drawings.

DETAILED DESCRIPTION OF THE PREFERRED EMBODIMENTS

Figure 1:
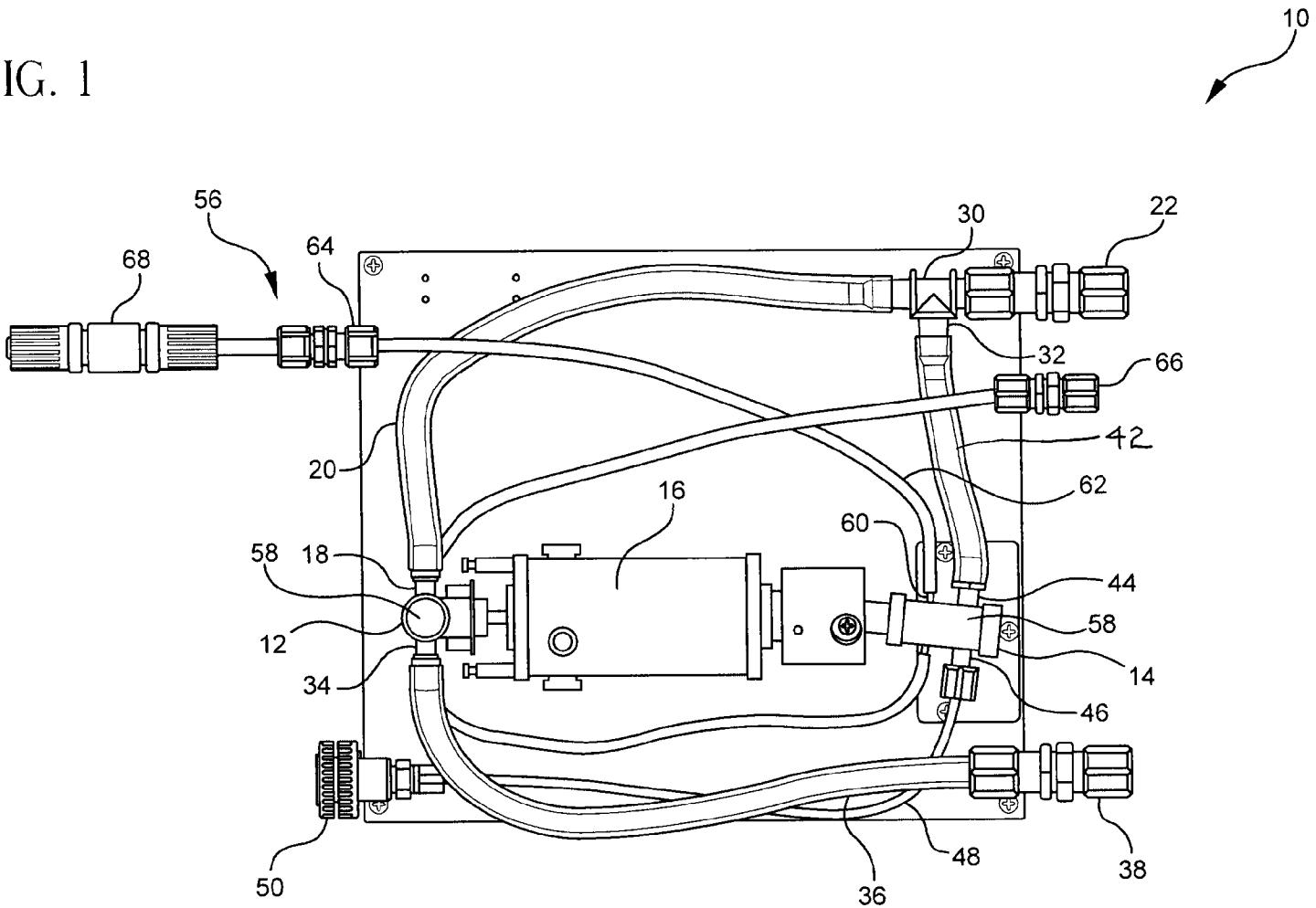
FIG. 1 is a cross-sectional view of one embodiment of the pumping apparatus formed in accordance with the present invention.
Figure 2:
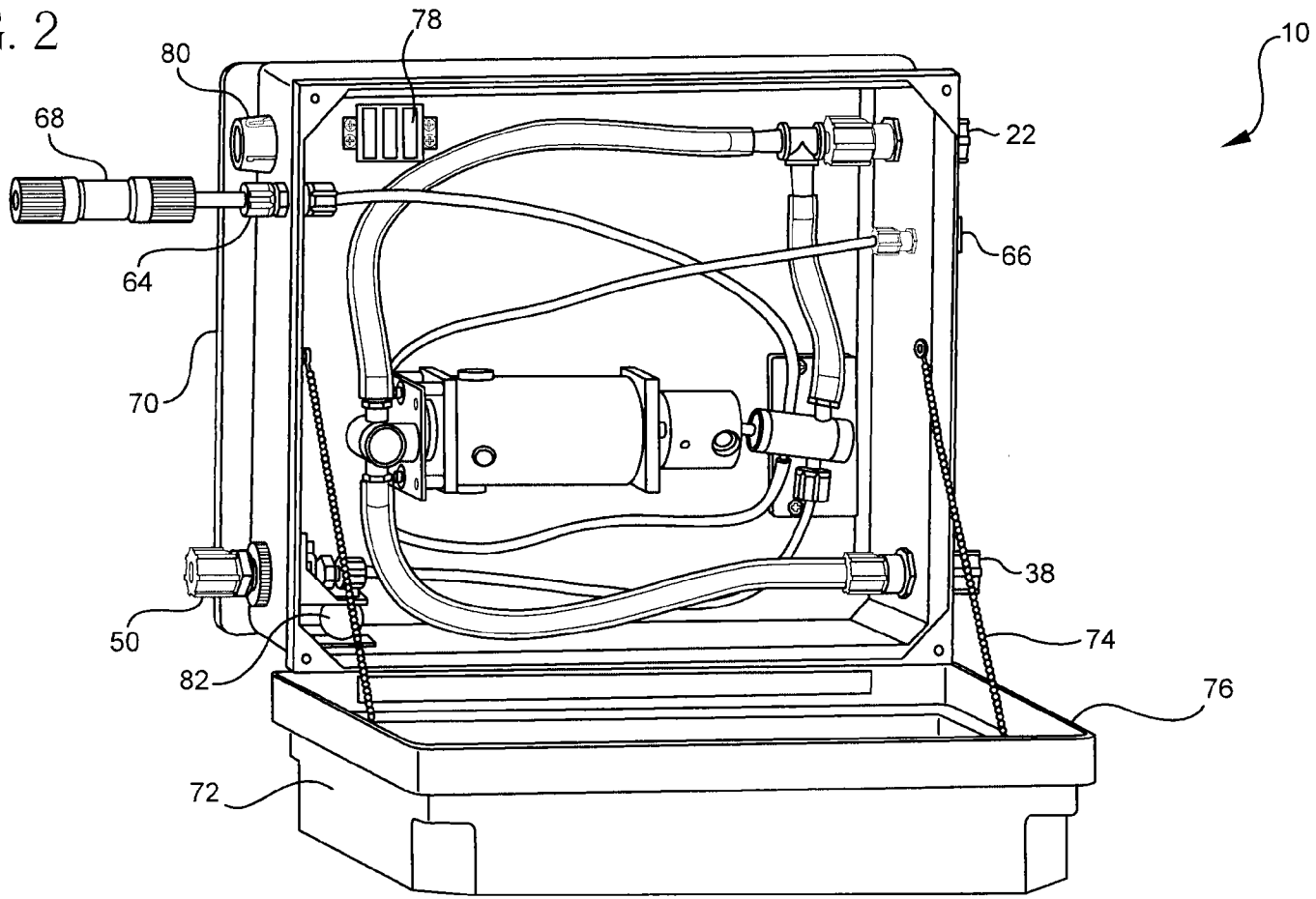
FIG. 2 is a perspective view of the pumping apparatus shown in FIG. 1 contained in a compact mountable case.

FIGS. 1 and 2 illustrate the preferred embodiment of the present invention. The present invention is a pumping apparatus 10, which generally includes a first pump 12 and a second pump 14 coaxially mounted to and driven by a motor 16. When the motor 16 is energized it drives both pumps 12 and 14 simultaneously.

Pumps 12 and 14 are preferably positive displacement pumps oriented in a horizontal arrangement wherein the axes of the pumps are horizontal with respect to the motor 16, as shown in FIG. 1. A desirable pump for use in the present invention as the first pump 12 is the "RO Pump" supplied by Fluid Metering, Inc., Syosset, N.Y. (www.fmipump.com). A desirable pump for use in the present invention as the second pump 14 is the "Q-1CTC Pump" also supplied by Fluid Metering, Inc.

Figure 3:
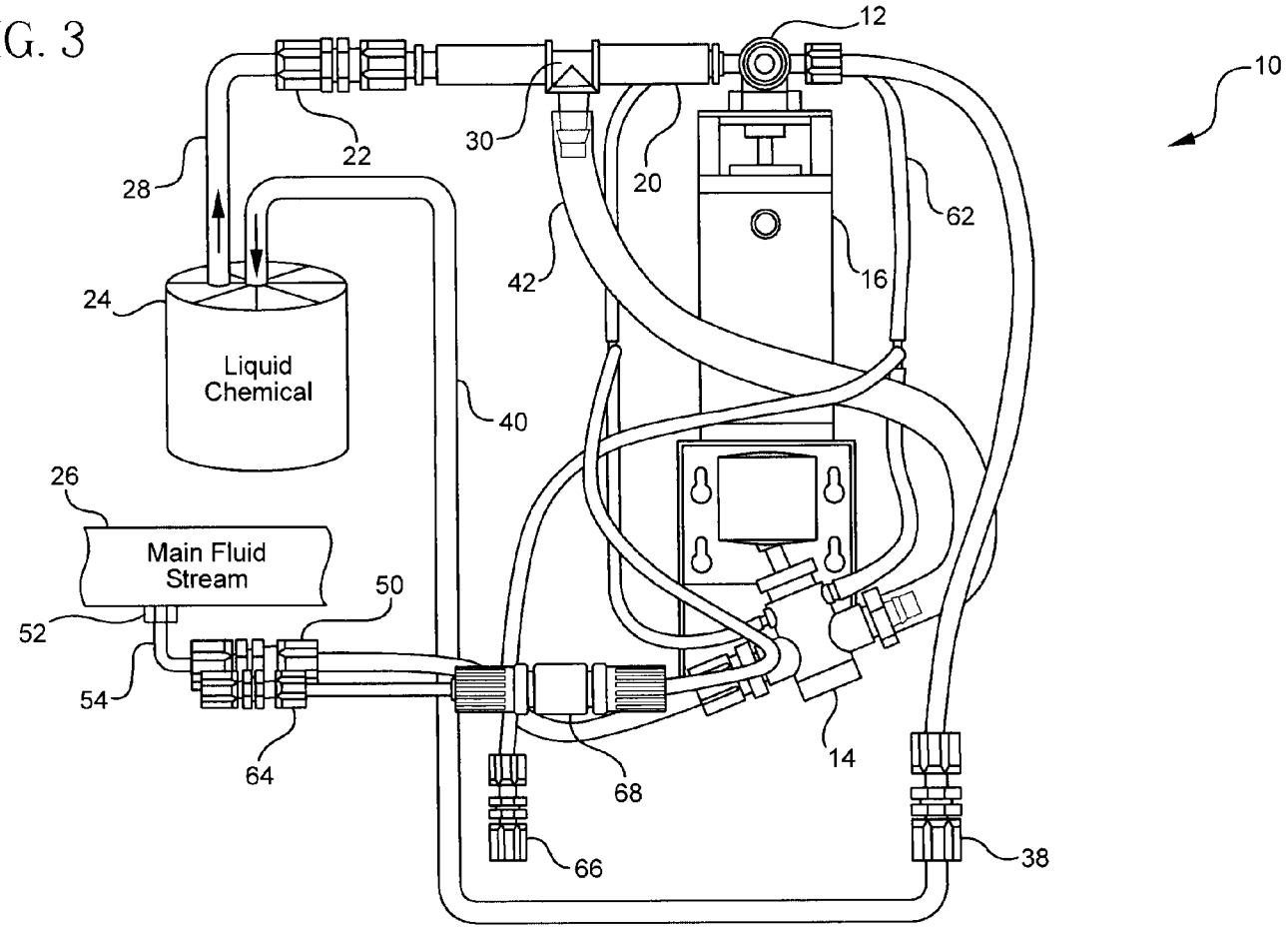
FIG. 3 is a cross-sectional view of an alternative embodiment of the pumping apparatus formed in accordance with the present invention.

While the first pump 12 is being driven by the motor 16, it draws a liquid into its intake port 18 via an intake conduit 20. At its opposite end, the intake conduit 20 is connected to an inlet 22, which in turn is adapted to be connected to a liquid source, such as a cistern 24 containing a chemical to be injected or fed into a main fluid stream 26, as shown in FIG. 3. The inlet 22 is preferably a quick-connect type fitting adapted to be fluidly connected to a hose, a pipe or other type of conduit 28 leading to the liquid source 24.

Interposed along the path of the intake conduit 20, between the intake port 18 of the pump 12 and the inlet 22, is a separator 30 for separating the liquid supplied from the liquid source 24 into a gaseous component and a liquid component. The separator 30 is preferably a junction, such as a T-fitting, oriented along the path of the intake conduit 20 to facilitate horizontal flow through the fitting and having one arm 32 oriented vertically downward. In this manner, as a gas/liquid mix passes through the T-fitting 30, the liquid component of the mixture falls downward through the vertical arm 32 of the fitting under the influence of gravity.

Any gaseous component of the liquid fed through the inlet 22 flows horizontally through the T-fitting 30 and is drawn into the intake port 18 of the first pump 12. This gaseous component is then discharged out of an output port 34 of the first pump 12 into a gas return tube 36, which terminates at a gas outlet 38 of the apparatus 10. The gas outlet 38 is also preferably a quick-connect type fitting adapted to be connected to a return line 40 running back to the liquid source 24, as shown in FIG. 3.

The vertical arm 32 of the T-fitting 30 is connected to a vertically oriented, large diameter liquid feed tube 42, which, at its opposite end, is connected to an intake port 44 of the second pump 14. This liquid feed tube 42 is preferably of large enough bore to avoid trapping bubbles under a liquid column. Experimentation has suggested that tubing with an internal diameter of about ⅜" works nicely in this regard.

The vertical orientation of the liquid feed tube 42 further ensures that the degassed liquid which has fallen down from the vertical arm 32 of the T-fitting 30 displaces any gas at the intake port 44 of the second pump 14. As a result, the second pump 14 is now self-priming.

The second pump 14 discharges the degassed liquid out of an output port 46 into a liquid discharge tube 48, which is connected to a liquid outlet 50. The liquid outlet 50 is again preferably a quick-connect type fitting, which is adapted to be connected to an inlet 52 of the main fluid stream 26 via a liquid feed line 54, as shown in FIG. 3. The second pump 14 thus delivers the degassed liquid to the main fluid stream 26 against the pressure head of the main supply.

The system 10, according to one embodiment of the present invention, further includes a wash-water subsystem 56 for lubricating and cleaning out the pumps 12 and 14. Specifically, each pump head 58 of the pumps 12 and 14 preferably include a feature called an "Isolation Gland" or "Wash Gland" wherein the pump head includes a pair of extra ports 60 which are connected to wash-water lines 62. The wash-water lines 62 fluidly connect a wash-water supply port 64 to a wash-water waste port 66, wherein the pump heads 58 may be connected in series along the wash-water line path, as shown in FIGS. 1 and 2, or they may be connected in parallel, as shown in FIG. 3.

The wash-water subsystem 56 further preferably includes a flow restrictor 68 for restricting the flow of the incoming wash-water into the wash-water supply port 64 before the water enters the pump heads 58. A suitable flow restrictor for use in the present invention is a 150 mL/min restrictor.

The wash-water subsystem 56 provides the function of maintaining clean pumps as described above and also provides a sort of lubrication to help the pump start up after extended periods of non-operation. The purpose of the flow restrictor 68 in the present invention is to regulate the amount of wash-water which is introduced into the wash glands of the two pump heads 58. Municipal water sources generally provide water at elevated pressure (upwards of 100 psig) and connections are made to large gate valves at convenient plumbing locations. Thus, regulation of water flow from these large valves, which normally are used to control rates of tens of liters per minute, through the device becomes important. The flow restrictor 68 eliminates any need on the part of the installer or maintenance technicians to adjust their water supply flow rate or pressure.

The pump system 10, according to the present invention, is preferably contained in a compact mountable box or case 70, as shown in FIG. 2. In particular, the components of the system 10 are conveniently contained within a case 70 having a hinged cover 72 with the inlet 22, the gas outlet 38, the liquid outlet 50, the wash-water inlet 64 and the wash-water outlet 66 extending from the exterior of the case. Thus, the case 70 can be mounted to a wall, for example, wherein the system 10 can be connected to on-site fluid lines via the various fluid connections 22, 38, 50, 64 and 66 which extend outside of the case.

In this regard, the cover 72 is preferably hinged to the case 70 to open in a downward direction when the case is mounted to the wall. The cover 72 further preferably includes at least one lanyard 74 for suspending the cover in a horizontal orientation with respect to the case. In this manner, the cover 72 provides a shelf for placing tools or other items during servicing or repair of the system. Preferably, the cover 72 defines an interior compartment 76 for holding such tools or spare parts.

The case 70 further provides convenient structure for mounting an electrical terminal 78 for providing electrical power to the motor 16 from an electrical source via electrical wiring (not shown) fed through an external electrical port 80 of the case. The electrical terminal 78 and port 80 are preferably mounted to an interior surface of the case generally above the pumping components so that any leakage in the system will not come into contact with the electrical connections of the terminal.

The case 70 further preferably includes a drain outlet 82 provided in a bottom surface of the case to drain any leakage in the system out of the case. The drain outlet 82 is preferably in the form of a check-valve or a ball-valve, which permits only one-way fluid flow out of the case 70. As a result, exterior contaminants are prevented from entering the case.

As mentioned above, the pumps 12 and 14 and the motor 16 are oriented horizontally. The purpose for this orientation is to prevent any possible damage to the electric motor 16 from liquid leakage which might issue from a pump 12 or 14. Specifically, when the pumps 12 and 14 are oriented horizontally with respect to the motor 16, any leakage from a pump will simply fall to the bottom of the case 70 and will be drained out of the case via the drain outlet 82.

An added advantage in orienting the assembly horizontally is improved performance with respect to liquid/gas separation. The horizontal assembly arrangement as shown in FIGS. 1 and 2 allows for a relatively straight vertical liquid feed tube 42, which facilitates bubbles rising to the top thereby readily separating the entrained gas bubbles. The full range of flow angles for the pumps 12 and 14 (typically ranging from 7.5°-to-22° are accommodated by this arrangement.

Nevertheless, it is totally conceivable to orient the pumps 12 and 14, with respect to the motor 16 in a vertical arrangement, as shown in the alternative embodiment of FIG. 3. This may be necessary, for example, due to the on-site limitations in installing the system. In this embodiment, the first pump 12 is positioned above the motor 16 and the second pump 14 is positioned below the motor. Operation of the system 10, however, is identical to that described above.

Figure 4:
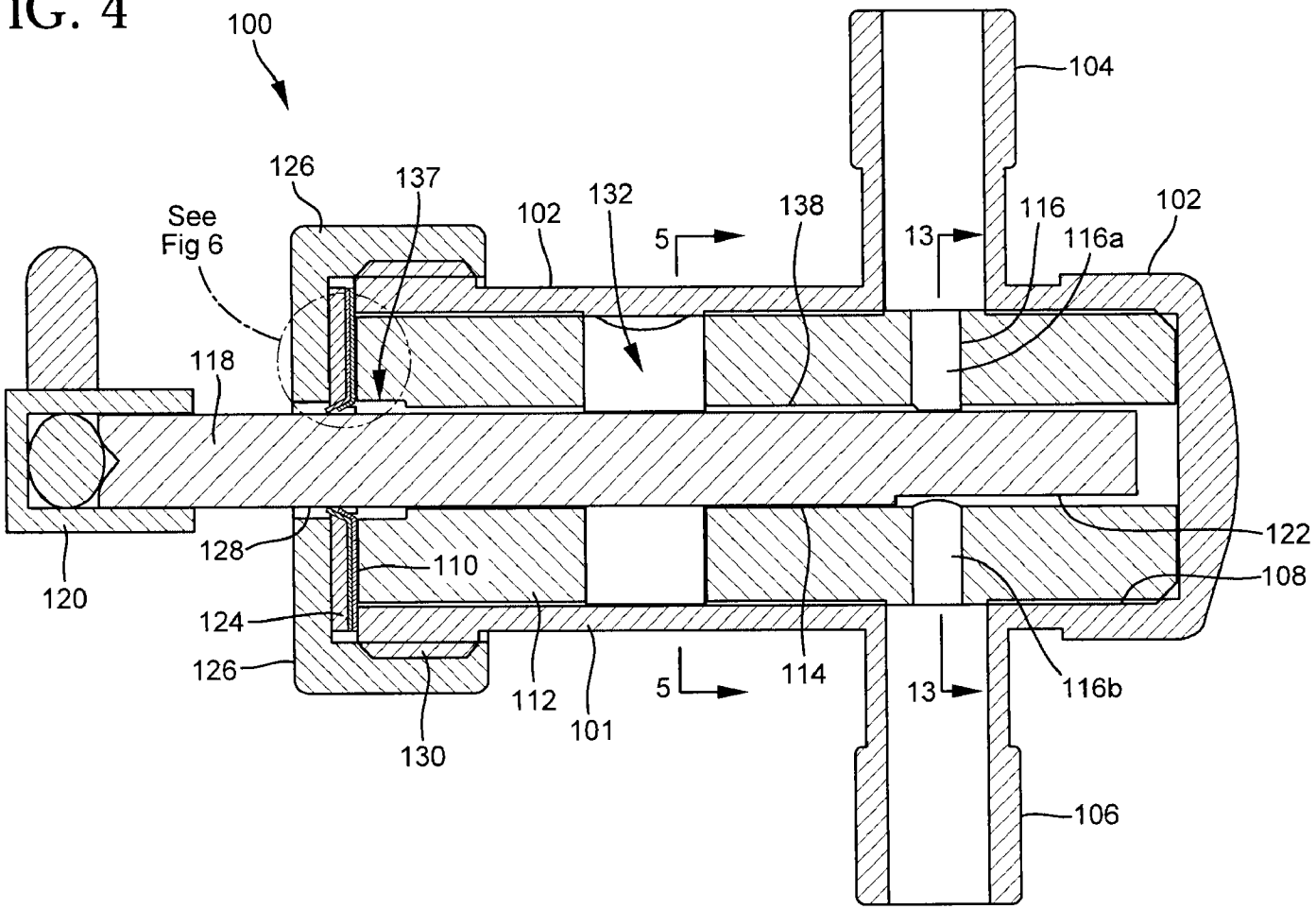
FIG. 4 is a cross-sectional view of the preferred embodiment of the pump according to the present invention.

FIG. 4 shows a preferred embodiment of a pump 100 for use in the present invention. The pump 100 generally includes a pump housing 101 and a piston 118. The pump housing 101 preferably includes a plastic pump casing 102 having an inlet port 104 and an outlet port 106. The pump casing 102 defines a cylindrical chamber 108 having an open end 110. Received in the cylindrical chamber 108 is a ceramic piston liner 112 having a central longitudinal bore 114 and a transverse bore 116 communicating with the longitudinal bore. The transverse bore 116 includes an inlet portion 116*a* fluidly communicating with the inlet port 104 of the pump casing 102 and an outlet portion 116*b* fluidly communicating with the outlet port 106 of the pump casing so that a liquid, such as a chlorine solution, can be pumped from the inlet port, through the liner, to the outlet port in a manner as will be described below.

The pump 100 further includes a ceramic piston 118 axially and rotatably slidable within the central bore 114 of the piston liner 112. One end of the piston 118 extends out of the open end 110 of the pump casing 102 and includes a coupling 120 for engagement with a motor. At its opposite end, the piston 118 is formed with a relieved portion 122 disposed adjacent the transverse bore 116 of the pump liner. As will be described below, the relieved portion 122 is designed to direct fluid into and out of the pump 100.

A lip seal assembly 124 is provided at the open end 110 of the pump casing 102 to seal the piston 118 and the pump chamber 108. The lip seal assembly 124 is retained at the open end 110 of the pump casing 102 by a gland nut 126 having a central opening 128 to receive the piston 118. The gland nut 126 is preferably attached to the pump casing 102 with a threaded connection 130 provided therebetween.

In operation, a motor (not shown in FIG. 4) drives the piston 118 to axially translate and rotate within the central bore 114 of the piston liner 112. In order to draw liquid into the transverse bore 116 from the inlet port 104, the piston 118 is rotated as required to align the relieved portion 122 with the inlet port. The piston 118 is then drawn back as required to take in the desired volume of liquid into the central bore 114 of the pump liner 112. Withdrawal of the piston 118 produces a negative pressure within the inlet portion 116*a* of the transverse bore 116, which draws in liquid from the inlet port 104. The piston 118 is then rotated to align the relieved portion 122 with the outlet port 106 of the pump casing 102. Finally, the piston 118 is driven forward the required distance to force liquid into the outlet port 106 via the outlet portion 116*b* of the transverse bore 116 to produce the desired discharge flow.

When pumping liquids with the pump shown in FIG. 4, some of the liquid will invariably seep into the space between the piston 118 and the piston liner 112. As mentioned above, one problem with pumping certain liquids, particularly NaOCl solutions, is the tendency for the liquid trapped between the piston 118 and the liner 112 to evaporate and crystallize during pump idle time. Such crystallization can build up on the piston 118 and eventually cause it to seize within the pump liner 112. As mentioned previously, precipitates resulting from reaction of the sodium hypochlorite solution and metallic salts, which may be present in the wash water, can contribute to this seizing problem. Elimination of the wash water will preclude any precipitates which are reaction products but that leaves the problem of crystallization unsolved.

A solution to this crystallization problem is to form the pump liner 112 with a liquid reservoir 132 in communication with the central bore 114 of the liner. The liquid reservoir 132 allows a sufficient volume of liquid to be maintained around the pump piston 118 so as to prevent crystallization of the liquid. Specifically, by trapping a sufficient volume of liquid within the liquid reservoir 132, the surface to volume ratio of the liquid surrounding the piston 118 is decreased, thereby decreasing the tendency for the liquid to evaporate and crystallize. It has been found that at least approximately 0.7 cc of liquid volume is sufficient to prevent crystallization of the liquid.

Figure 5A:
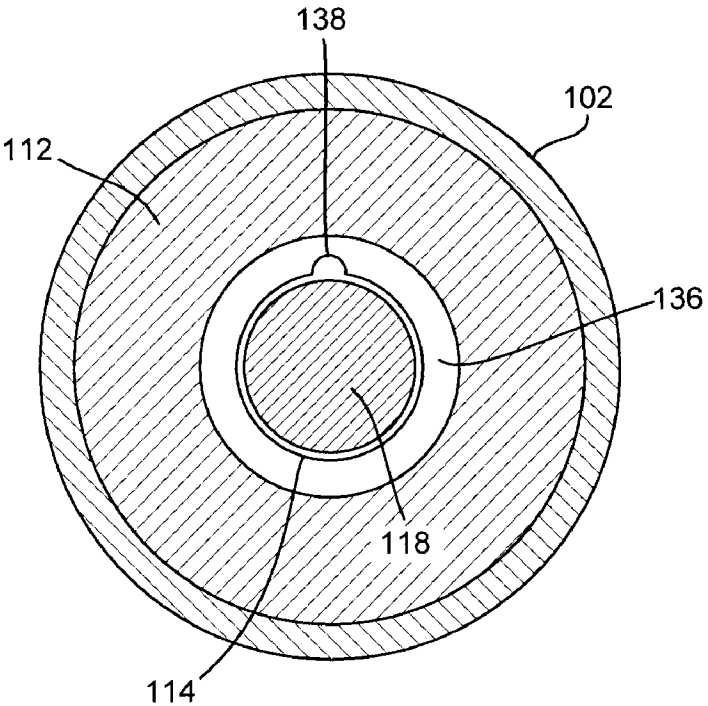
FIG. 5*a* is a cross-sectional view of an alternative embodiment of the pump shown in FIG. 4 taken along line 5-5.
Figure 5:
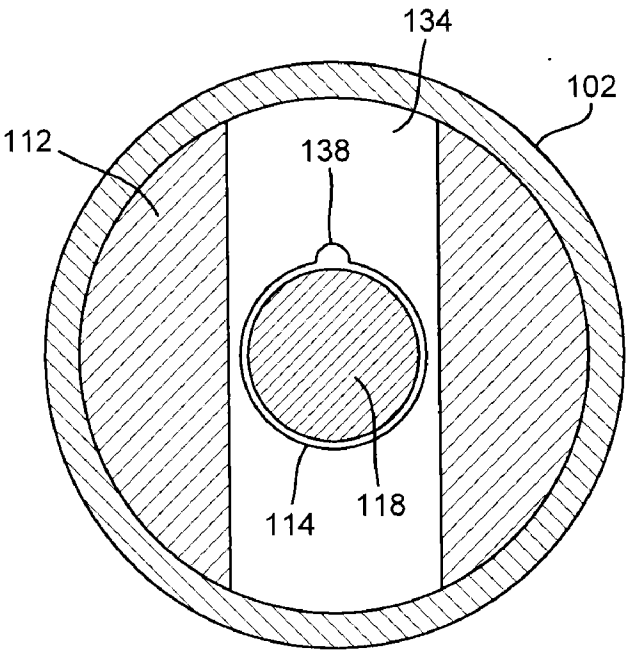
FIG. 5 is a cross-sectional view of the pump shown in FIG. 4 taken along line 5-5.

The liquid reservoir 132 can take the form of a transverse bore 134 formed in the liner 112 and having a width greater than the diameter of the liner central bore 114, as shown in FIG. 5. Alternatively, the liquid reservoir 132 can take the form of an annular counter-bore 136 formed in the liner 112 surrounding the liner central bore 114, as shown in FIG. 5*a*. Also, a counter bore 137 may be provided in the liner 112 surrounding the central bore 114 at the open end 110 of the liner in addition to the liquid reservoir 132. The counter bore 137 provides an additional reservoir for storing lubricating liquid.

It can thus be seen that the liquid reservoir 132 eliminates the need for a wash-water system 56, as described above. Instead, lubrication and cleaning of the pumps, which had been provided by the water of the wash-water system, is now achieved by the pumping liquid. Eliminating the wash-water system results in only one liquid being present within the pump, thereby eliminating the chance of adverse liquid mixing reactions (e.g., copper and rust contamination).

To increase the fluid flow surrounding the piston 118 and thereby further decrease the chance for this liquid to evaporate, the liner 112 is further preferably formed with a pressure relief slot 138 (also termed a "scavenger slot"). The pressure relief slot 138 communicates with and extends longitudinally along the central bore 114 of the liner 112 from the open end 110 of the liner to the inlet portion 116*a* of the transverse bore 116. The pressure relief slot 138 thus formed facilitates fluid flow back to the inlet portion 116*a* of the transverse bore 116 due to the negative pressure created at the inlet portion by movement of the piston 118. In other words, the negative pressure created at the inlet portion 116*a* of the transverse bore 116 tends to draw the liquid surrounding the piston 118 back to the inlet portion via the pressure relief slot 138. Also, since the outlet portion 116*b* of the transverse bore continuously sees a positive pressure, even during pump idle times, any migration of trapped liquid toward the negative pressure inlet portion 116*a* will be replaced with fresh liquid thereby further inhibiting crystallization.

Figure 6:
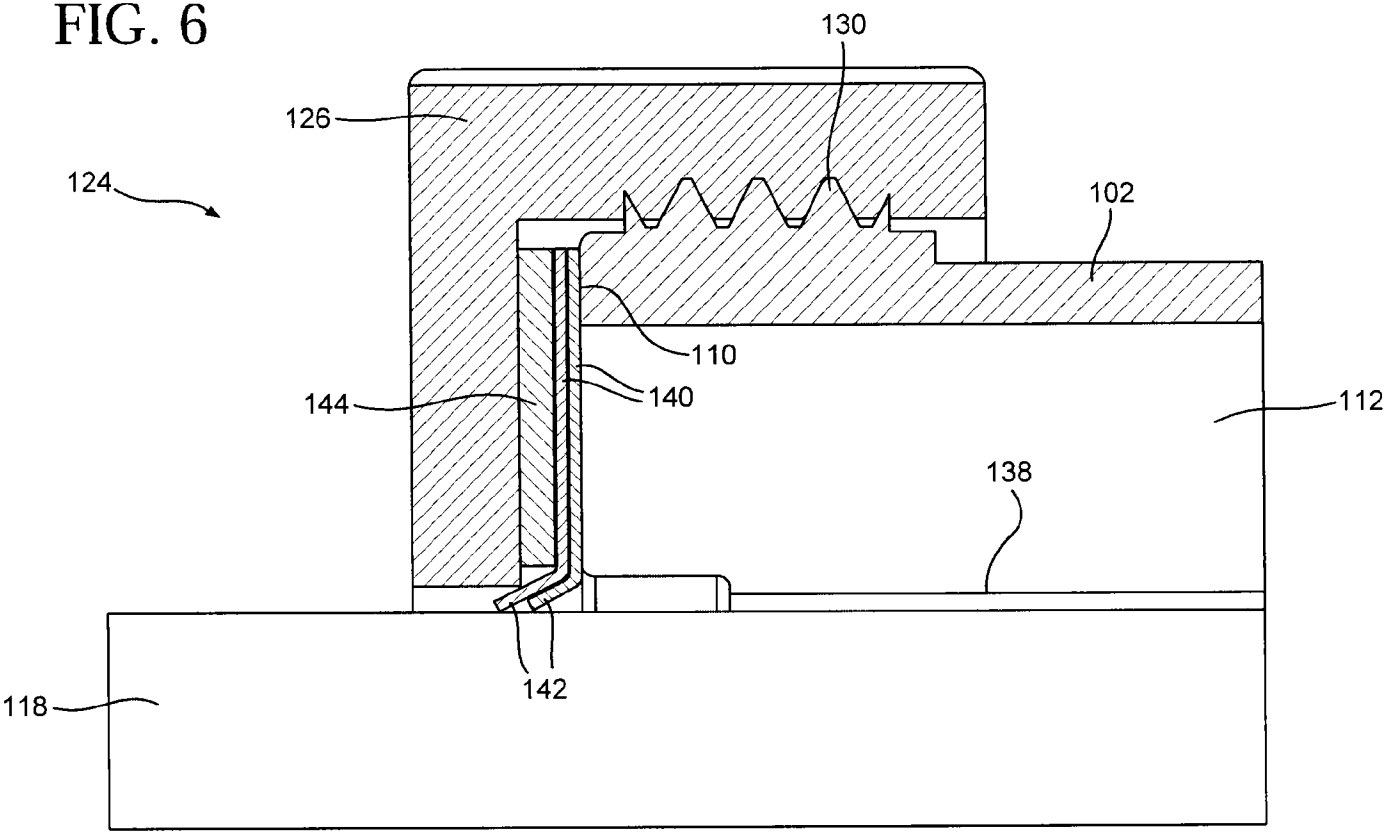
FIG. 6 is an enlarged cross-sectional view of the pump seals shown in FIG. 4.

An additional benefit of the pressure relief slot 138 is a reduction in leakage from the open end 110 of the piston casing 102. As described above, the pressure relief slot 138 draws the liquid away from the open end 110 of the pump casing 102 toward the transverse bore 116. Thus, the natural tendency of the fluid flow will not be toward the open end 110 of the casing 102. This enables the lip seal assembly 124 to be arranged in an advantageous manner. Specifically, rather than having two lip seals arranged "back-to-back," wherein the lips of the seal are bent in opposite directions, the lip seal assembly of the present invention can include two ceramic loaded polytetrafluoroethylene (PTFE) lip seals 140 sandwiched together such that their bent lips 142 both face outwardly away from the interior chamber 108 of the piston casing 102, as shown in FIG. 6. A white Teflon washer 144 may also be provided between the lip seals 140 and the gland nut 126 to help secure the lip seals against the open end 110 of the pump casing 102.

By having both lip portions 142 face away from the interior of the pump casing, any debris from erosion of the lip seal 140 will tend to travel away from the interior of the pump rather than travel into the pump. The benefit again is to reduce the chance of material entering the pump and causing the piston to seize.

Also, having both lip portions 142 of the seal facing outwardly increases the scraping ability of the lip seal to remove any debris or residue from the outside of the piston 118 before entering the pump. In this regard, it is preferred to coat the outside of the ceramic piston 118 with a vapor-deposited polytetrafluoroethylene (PTFE) coating, as described in commonly owned U.S. Publication Nos. 2004-0241023-A1 and 2005-0276705-A1.

The present invention is particularly suitable for implementation as part of a chlorination system, wherein relatively small amounts of sodium hypochlorite (NaOCl) solution are injected or fed into a water stream. Such chlorination systems include those utilized by municipal water providers and swimming pool facilities.

Although preferred embodiments of the present invention have been described herein with reference to the accompanying drawings, it is to be understood that the invention is not limited to those precise embodiments and that various other changes and modifications may be affected herein by one skilled in the art without departing from the scope or spirit of the invention, and that it is intended to claim all such changes and modifications that fall within the scope of the invention.

What is claimed is:

1. A chlorination system for feeding a chlorine solution into water comprising:

a source of chlorine solution;

a motor;

a first and second pump driven by said motor, at least one of said first and second pumps comprising a pump housing and a pump piston coupled to said motor, said pump housing defining a central longitudinal bore, a transverse bore and a liquid reservoir, said central longitudinal bore receiving said piston, said transverse bore communicating with said central bore for conveying the chlorine solution through said pump housing and said liquid reservoir communicating with said central bore and said transverse bore for retaining an amount of the chlorine solution conveyed through said transverse bore; and a separator in fluid communication with said source of chlorine solution and said first and second pumps for separating chlorine solution received from said source into a gaseous component and a liquid component, said separator further diverting said gaseous component to said first pump and said liquid component to said second pump, wherein said first pump pumps said gaseous component back to said chlorine solution source and said second pump pumps said liquid component into a supply of water.

2. A chlorination system as defined in claim 1, wherein said pump housing of said pump further includes an inlet port and an outlet port, and said transverse bore includes an inlet portion extending between said inlet port and said central bore and an outlet portion extending between said central bore and said outlet port.

3. A chlorination system as defined in claim 2, wherein said pump housing of said pump further comprises a pressure relief slot formed in said central bore between said inlet portion of said transverse bore and said liquid reservoir to facilitate liquid flow therebetween.

4. A chlorination system as defined in claim 3, wherein said central bore terminates at an opening formed in said housing, said piston extending out from said opening and said pressure relief slot extending from said inlet portion of said transverse bore to said housing opening.

5. A chlorination system as defined in claim 4, wherein said pump further comprising a lip seal assembly disposed at said housing opening for sealing said piston, said lip seal assembly including two annular lip seals having lip portions in sliding contact with said piston, said lip portions being bent outwardly away from said housing opening.

6. A chlorination system as defined in claim 5, wherein said piston of said pump further includes an outer surface having a vapor-deposited polytetrafluoroethylene (PTFE) coating.

7. A chlorination system as defined in claim 1, wherein said liquid reservoir of said pump comprises a second transverse bore having a width greater than the diameter of said central bore.

8. A chlorination system as defined in claim 1, wherein said liquid reservoir of said pump comprises an annular counter bore surrounding said central bore.

* * * * *